US011756502B2

(12) United States Patent
Guo et al.

(10) Patent No.: US 11,756,502 B2
(45) Date of Patent: Sep. 12, 2023

(54) SYSTEM AND METHOD FOR PROVIDING FAST RESPONSE TIME PERFORMANCE WITH LOW LATENCY IN LIQUID CRYSTAL DISPLAYS

(71) Applicant: Dell Products, L.P., Round Rock, TX (US)

(72) Inventors: Lei Guo, Singapore (SG); Eng Cheng Vincent Yap, Singapore (SG); Bee June Tye, Singapore (SG)

(73) Assignee: Dell Products, L.P., Round Rock, TX (US)

( * ) Notice: Subject to any disclaimer, the term of this patent is extended or adjusted under 35 U.S.C. 154(b) by 0 days.

(21) Appl. No.: 17/650,717

(22) Filed: Feb. 11, 2022

(65) Prior Publication Data

US 2023/0260477 A1 Aug. 17, 2023

(51) Int. Cl.
*G09G 5/00* (2006.01)
*G09G 3/36* (2006.01)

(52) U.S. Cl.
CPC ..... *G09G 5/003* (2013.01); *G09G 3/3618* (2013.01); *G09G 2340/0435* (2013.01); *G09G 2360/18* (2013.01); *G09G 2370/047* (2013.01)

(58) Field of Classification Search
CPC .... G09G 3/3614; G09G 5/39; G09G 2360/18; G09G 2320/0204
See application file for complete search history.

(56) References Cited

U.S. PATENT DOCUMENTS 6,532,024 B1 * 3/2003 Everett ..... H04N 7/012 345/440
2004/0243940 A1 * 12/2004 Lee ..... G06F 3/04897 715/744
2005/0052394 A1 * 3/2005 Waterman ..... G09G 3/3614 345/98
2005/0160367 A1 * 7/2005 Sirota ..... G06Q 10/1095 715/752
2006/0282737 A1 * 12/2006 Shi ..... H04N 21/4425 714/746
2007/0242160 A1 * 10/2007 Garg ..... H04N 5/21 348/565
2015/0339994 A1 * 11/2015 Verbeure ..... G09G 5/363 345/214

* cited by examiner

*Primary Examiner* — Shaheda A Abdin
(74) *Attorney, Agent, or Firm* — Fogarty LLP

(57) ABSTRACT

According to various embodiments of the present disclosure, a system and method for providing fast response time performance with low latency in Liquid Crystal Displays (LCDs) are described. In some embodiments, an Information Handling System (IHS) may include a controller and a memory coupled to the controller, the memory having program instructions stored thereon that, upon execution, cause the controller to receive LCD display capability information from a display device, and determine from the received capability information, that a video stream sent to the display device has a lower frame rate than the capabilities of the display device. Using this information the instructions then increase the frame rate of the video stream by repeating each frame during a current time window of the frame.

20 Claims, 9 Drawing Sheets

400

| 17x17 OD LUT | | TO | | | | | | | | | | | | | | | | |
|---|---|---|---|---|---|---|---|---|---|---|---|---|---|---|---|---|---|---|
| | | 0 | 16 | 32 | 48 | 64 | 80 | 96 | 112 | 128 | 144 | 160 | 176 | 192 | 208 | 224 | 240 | 255 |
| FROM | 0 | | 21 | 46 | 65 | 81 | 118 | 130 | 153 | 172 | 197 | 220 | 223 | 247 | 248 | 255 | 255 | 255 |
| | 16 | 0 | | 37 | 58 | 78 | 107 | 123 | 147 | 165 | 190 | 212 | 219 | 242 | 244 | 255 | 255 | 255 |
| | 32 | 0 | 11 | | 52 | 73 | 100 | 119 | 140 | 159 | 185 | 209 | 215 | 236 | 242 | 255 | 255 | 255 |
| | 48 | 0 | 9 | 26 | | 68 | 96 | 113 | 135 | 153 | 179 | 204 | 211 | 233 | 239 | 255 | 255 | 255 |
| | 64 | 0 | 8 | 21 | 41 | | 84 | 108 | 129 | 149 | 174 | 199 | 208 | 230 | 236 | 255 | 255 | 255 |
| | 80 | 0 | 7 | 20 | 35 | 59 | | 102 | 124 | 146 | 169 | 195 | 204 | 227 | 233 | 255 | 255 | 255 |
| | 96 | 0 | 7 | 19 | 33 | 54 | 75 | | 118 | 141 | 163 | 187 | 198 | 223 | 231 | 255 | 255 | 255 |
| | 112 | 0 | 6 | 18 | 32 | 52 | 70 | 89 | | 134 | 157 | 175 | 195 | 220 | 229 | 252 | 255 | 255 |
| | 128 | 0 | 6 | 17 | 32 | 51 | 68 | 82 | 106 | | 150 | 168 | 189 | 217 | 226 | 249 | 255 | 255 |
| | 144 | 0 | 5 | 16 | 31 | 50 | 66 | 81 | 100 | 123 | | 162 | 185 | 212 | 223 | 245 | 255 | 255 |
| | 160 | 0 | 5 | 16 | 31 | 50 | 65 | 77 | 98 | 118 | 139 | | 180 | 205 | 219 | 241 | 255 | 255 |
| | 176 | 0 | 4 | 15 | 28 | 47 | 60 | 74 | 96 | 112 | 134 | 155 | | 198 | 216 | 237 | 255 | 255 |
| | 192 | 0 | 3 | 14 | 26 | 47 | 56 | 72 | 92 | 108 | 128 | 150 | 171 | | 213 | 233 | 251 | 255 |
| | 208 | 0 | 3 | 13 | 25 | 43 | 52 | 67 | 88 | 105 | 125 | 144 | 166 | 186 | | 230 | 248 | 255 |
| | 224 | 0 | 3 | 12 | 24 | 40 | 48 | 63 | 85 | 102 | 118 | 141 | 162 | 180 | 203 | | 245 | 255 |
| | 240 | 0 | 2 | 10 | 22 | 38 | 46 | 59 | 83 | 97 | 112 | 131 | 157 | 175 | 198 | 219 | | 255 |
| | 255 | 0 | 1 | 9 | 20 | 35 | 43 | 55 | 79 | 93 | 106 | 121 | 135 | 170 | 194 | 205 | 234 | |

FIG. 4

SYSTEM AND METHOD FOR PROVIDING FAST RESPONSE TIME PERFORMANCE WITH LOW LATENCY IN LIQUID CRYSTAL DISPLAYS

BACKGROUND

As the value and use of information continues to increase, individuals and businesses seek additional ways to process and store information. One option is an Information Handling System (IHS). An IHS generally processes, compiles, stores, and/or communicates information or data for business, personal, or other purposes. Because technology and information handling needs and requirements may vary between different applications, IHSs may also vary regarding what information is handled, how the information is handled, how much information is processed, stored, or communicated, and how quickly and efficiently the information may be processed, stored, or communicated. The variations in IHSs allow for IHSs to be general or configured for a specific user or specific use such as financial transaction processing, airline reservations, enterprise data storage, global communications, etc. In addition, IHSs may include a variety of hardware and software components that may be configured to process, store, and communicate information and may include one or more computer systems, data storage systems, and networking systems.

IHSs often include (or are coupled to) display devices, such as liquid crystal display (LCD) panels. LCD panels are progressively scanned, meaning that at any given time instant, partial frames of both the previous and current frame are visible on the screen along with a progressively moving tear boundary. This scan and hold characteristic is well-suited for the display of static image content, but is undesirable for the display of video that contains motion. In general, this is due to the inadequate pixel response times of LCD panels.

Each pixel in a LCD panel includes a column of liquid crystal molecules suspended between two transparent electrodes that are in turn sandwiched between two polarizing filters whose axes of polarity are perpendicular to each other. By applying voltage to the transparent electrodes over each pixel, the corresponding liquid crystal molecules are "twisted" by electrostatic forces, allowing varying degrees of light to pass through the polarizing filters. Due to their electro-optical nature, the liquid crystal materials used in LCD panels have inertia and cannot be switched instantaneously. This results in transition response times that are generally not fast enough for high quality video applications. This slow response time, or latency, can result in video motion artifacts that cause quickly moving objects to appear visually blurred, an effect known as "ghosting" or "smearing."

LCD response times continue to improve, but vendor specifications are generally limited to "off-to-on," "rise and fall," or "black-to-white" response time, which is the time it takes a pixel to change from black to white (rise) and then back to black (fall). The voltage required to change a LCD pixel from black to white, or white to black is often greater than the voltage to change a pixel from one shade of grey to another. This disparity in voltage differential is the reason "black-to-white" response time is much faster than "grey-to-grey" response time, which is defined as the time it takes a pixel to change from one shade of grey to another. Grey-to-grey response times for LCD panels can be many times longer (e.g., 30 to 50 milliseconds.) than corresponding "black-to-white" response times.

Video frame rates are typically on the order of 17 milliseconds at 60 Hertz, which can be shorter than liquid crystal "grey-to-grey" response time. These frame rates, when combined with motion within the video frame, can result in video artifacts that cause smearing and low video quality. This problem extends to all LCD displays, but it is more of an issue for LCD panels used in portable IHSs due to their typically lower power consumption and correspondingly slow response times. In addition, due to limited battery life, power adapter capacity, cooling limitations, fan noise and other operational and design constraints, portable IHSs are generally designed to efficiently use computation cycles and minimize the associated overhead required to display an image.

Current approaches to address slow pixel response times include LCD Response Time Compensation (LRTC), which may also be referred to as overdrive compensation. In general, LRTC comprises a technique for mitigating video artifacts that can contribute to smearing when motion video is displayed on a LCD screen. LRTC addresses slow intrinsic response times by imposing an extrinsic overdrive voltage for each pixel to be written, based on the prior and next pixel values and the predetermined characteristics of the LCD panel.

Extended Display Identification Data (EDID), which is a standard published by the Video Electronics Standards Association (VESA), is a metadata format that has been developed for display devices to inform an IHS of their capabilities. An EDID-based data structure may include information, such as the make and model of the display device, supported frame rates, luminance data, and the like. The Display Data Channel (DDC) standard, which is a companion of the EDID, specifies protocols for communication between an IHS and its display device. For instance, the DDC standard may be used to enable the computer host to adjust monitor parameters, such as frame rate, color balance, screen position, brightness, contrast to name a few. The EDID and DDC standards collectively provide a means for optimally reproducing video imagery from video streams generated by the IHS.

SUMMARY

Systems and methods for providing fast response time performance with low frame rate video streams are described. In some embodiments, an Information Handling System (IHS) may include a controller and a memory coupled to the controller, the memory having program instructions stored thereon that, upon execution, cause the controller to receive LCD display capability information from a display device, and determine from the received capability information, that a video stream sent to the display device has a lower frame rate than the capabilities of the display device. Using this information the instructions then increase the frame rate of the video stream by repeating each frame during a current time window of the frame.

According to another embodiment, a video frame response time enhancement method includes the steps of receiving LCD display capability information from a display device, and determining, using the received capability information, that a video stream sent to the display device has a lower frame rate than the capabilities of the display device. The method may then increase the frame rate of the video stream by repeating each frame during a current time window of the frame.

According to yet another embodiment, a memory storage device with program instructions stored thereon that upon execution, cause an Information Handling System (IHS) to receive LCD display capability information from a display device, determine, using the received LCD display capability information, that a video stream sent to the display device has a lower frame rate than the capabilities of the display device, and increase the frame rate of the video stream by repeating each frame during a current time window of the frame.

BRIEF DESCRIPTION OF THE DRAWINGS

Having thus described the invention in general terms, reference will now be made to the accompanying drawings. The present invention(s) is/are illustrated by way of example and is/are not limited by the accompanying figures, in which like references indicate similar elements. Elements in the figures are illustrated for simplicity and clarity, and have not necessarily been drawn to scale.

Figure 1:
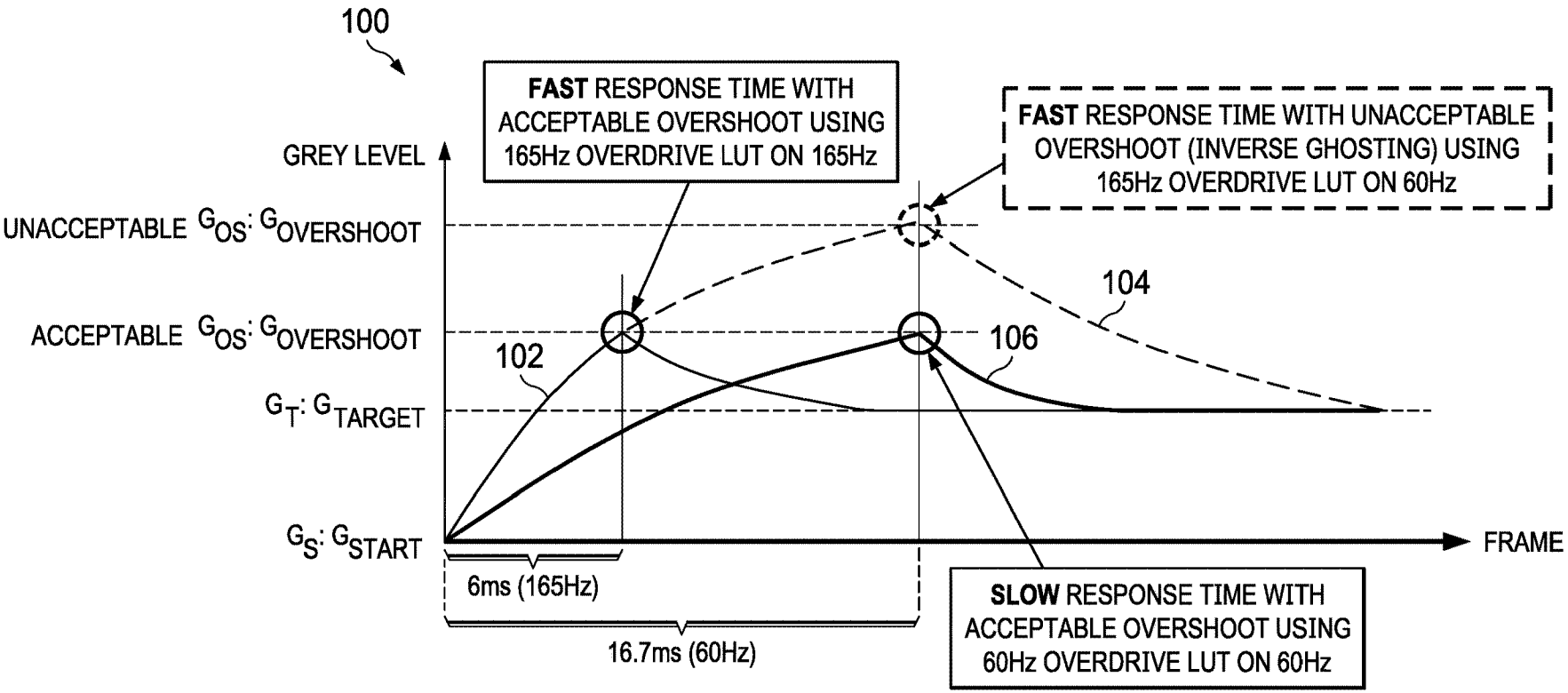

FIG. 1 illustrates how utilizing a LCD display device with RTC/OD compensation designed for high frame rate video streams may encounter problems when processing a low frame rate video stream according to one embodiment of the present disclosure.

Figure 2A:
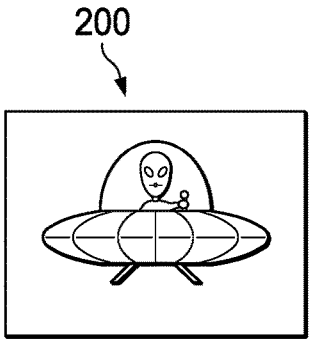
Figure 2B:
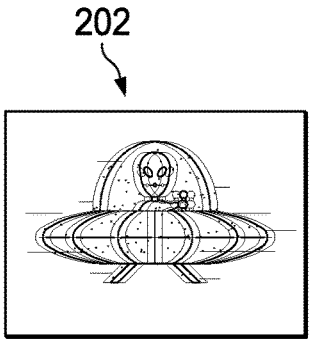
Figure 2C:
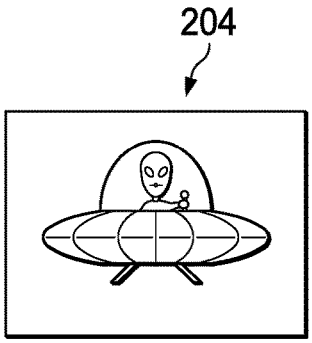

FIGS. 2A, 2B, and 2C illustrate video imagery that may result via the first, second, and third GLRC curves of FIG. 1 according to one embodiment of the present disclosure.

Figure 3:
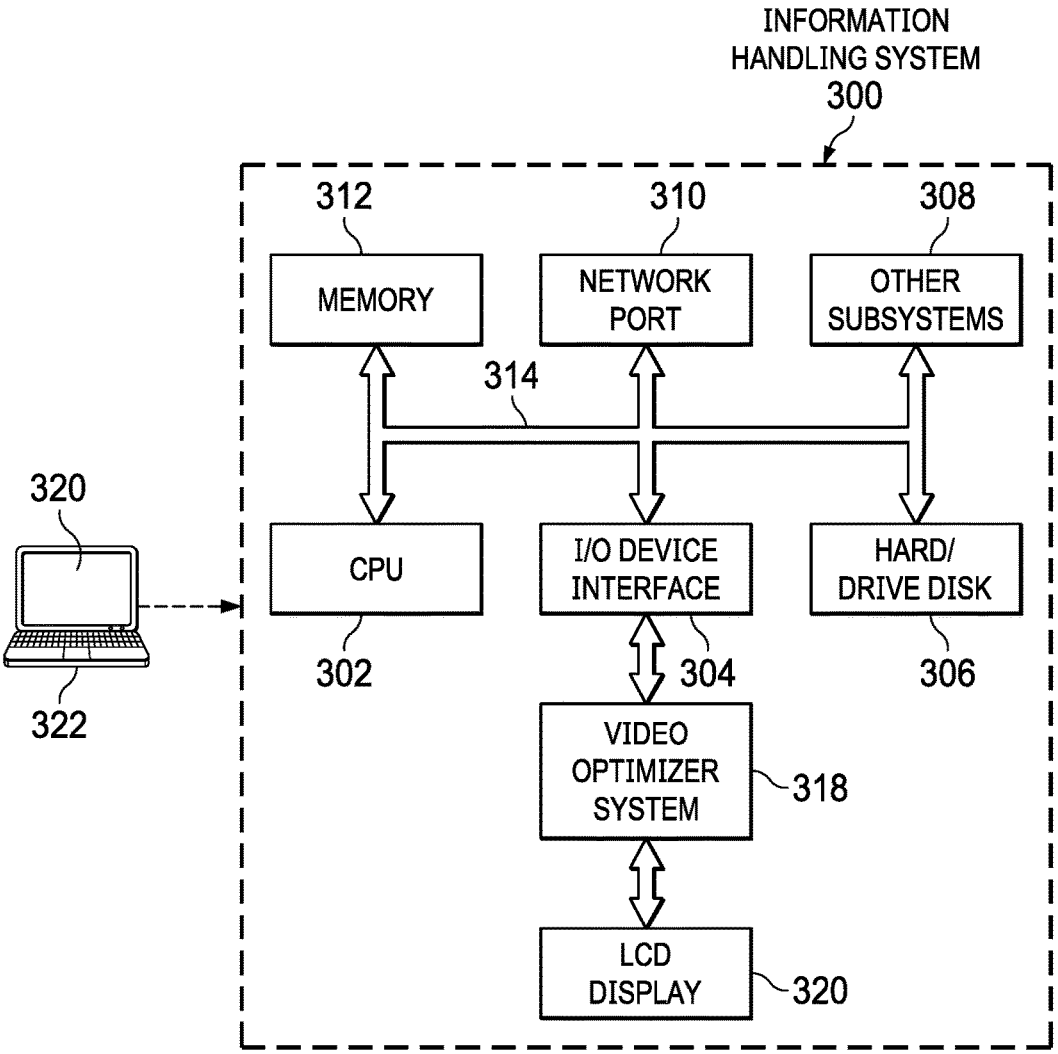

FIG. 3 illustrates a block diagram of example components of an Information Handling System (IHS) configured to implement a Response Time Compensation (RTC) system for progressive scan LCD displays according to one embodiment of the present disclosure.

FIG. 4 illustrates an example overdrive (OD) LUT that may be used to implement the fast response time system according to one embodiment of the present disclosure.

Figure 5:
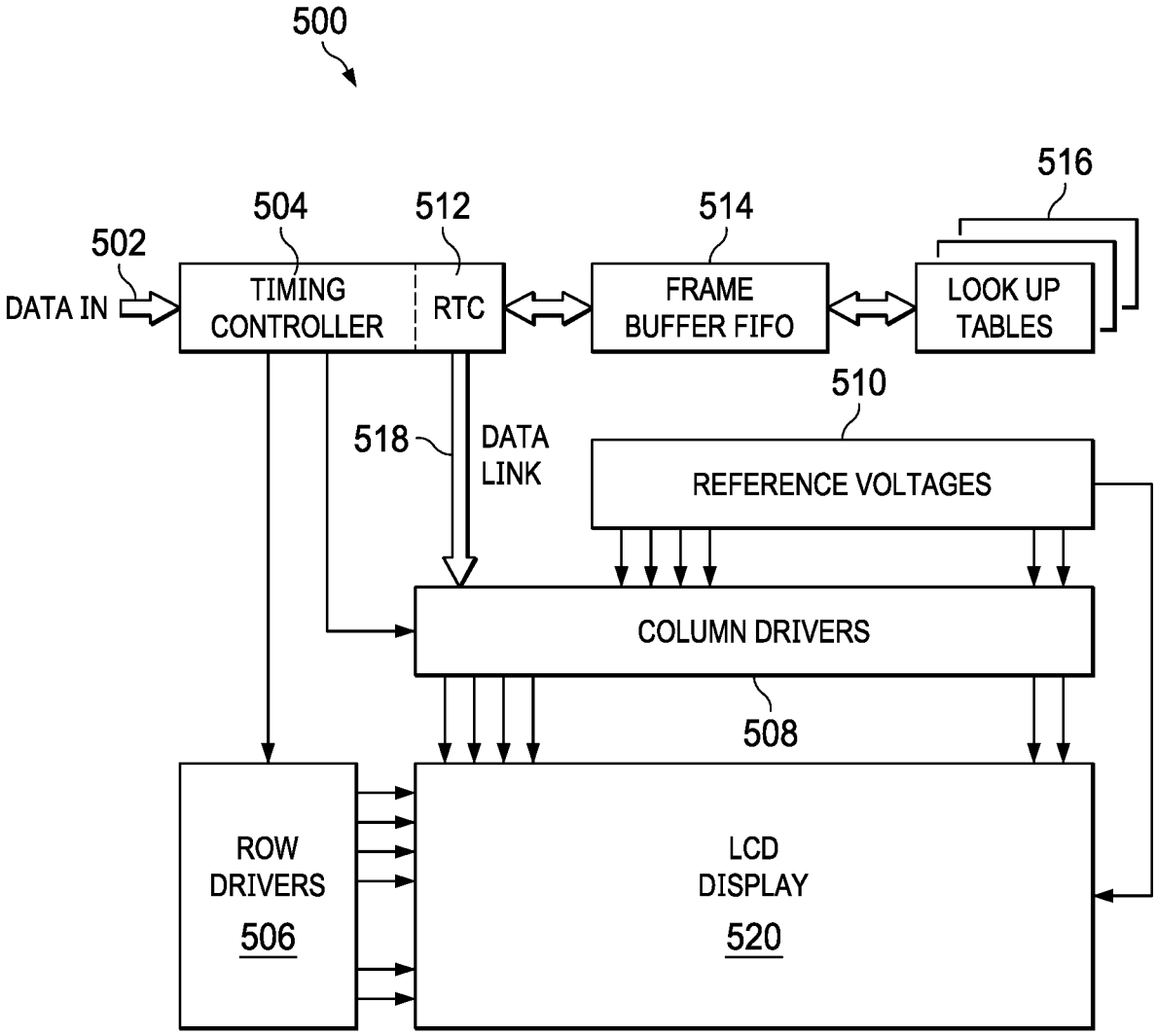

FIG. 5 is a block diagram illustration of an embodiment of a Response Time Compensation (RTC) system according to one embodiment of the present disclosure.

Figure 6:
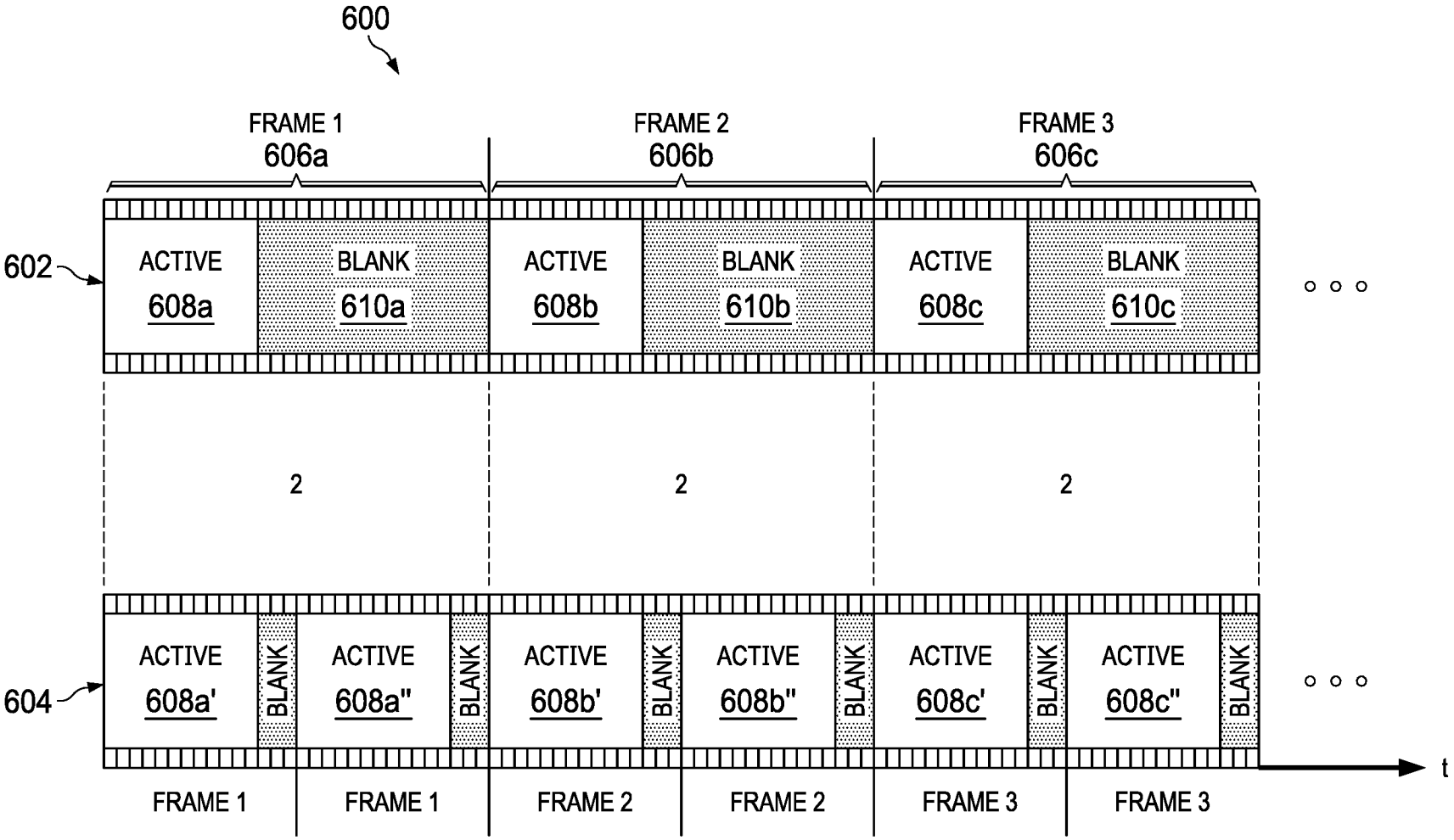

FIG. 6 illustrates an example timing diagram showing how a video frame response time enhancement system may repeat the frames of a low frame rate video stream to form a high frame rate video stream according to one embodiment of the present disclosure.

Figure 7:
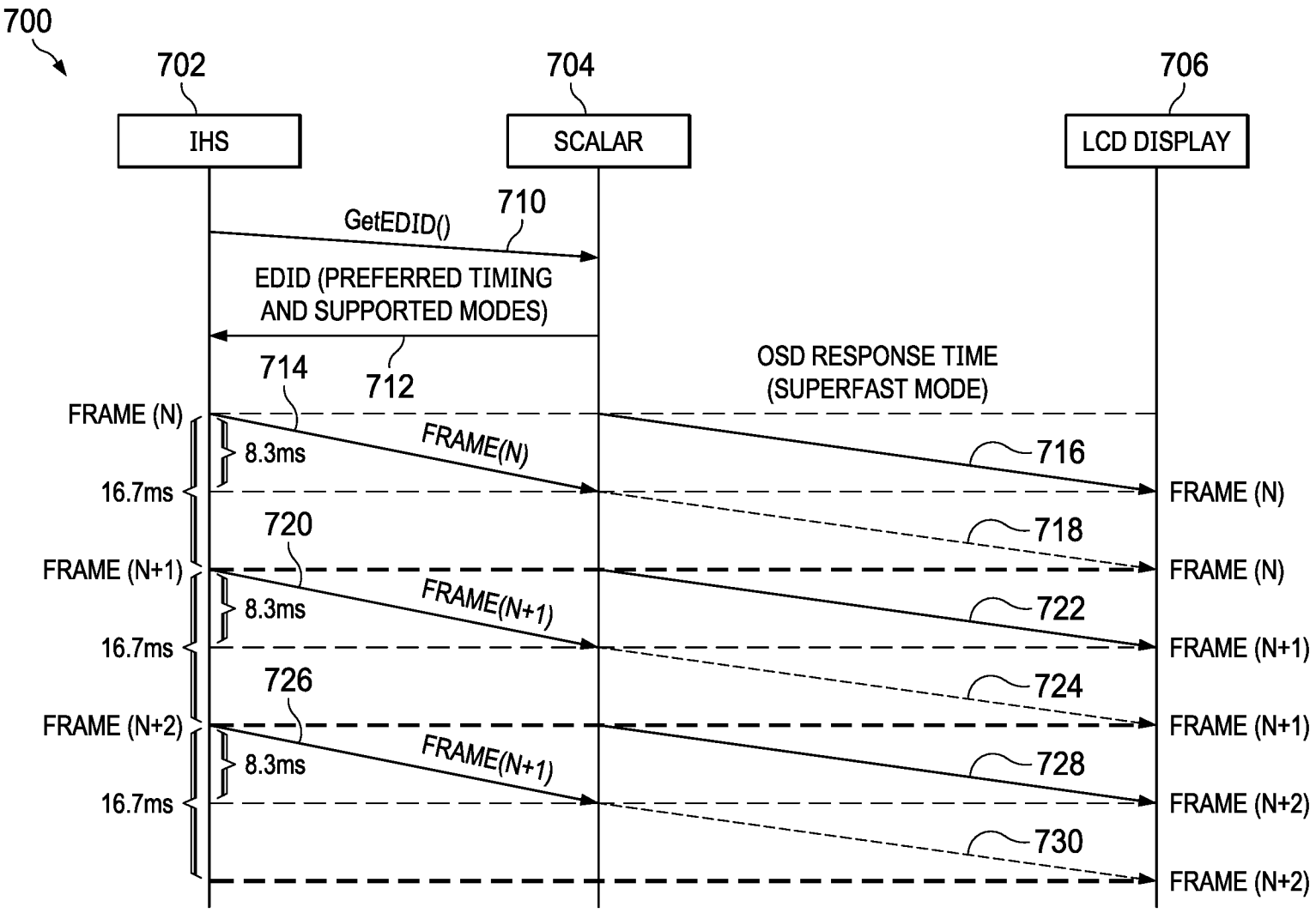

FIG. 7 is a flow diagram depicting certain steps of one embodiment of a video frame response time enhancement method according to one embodiment of the present disclosure.

Figure 8:
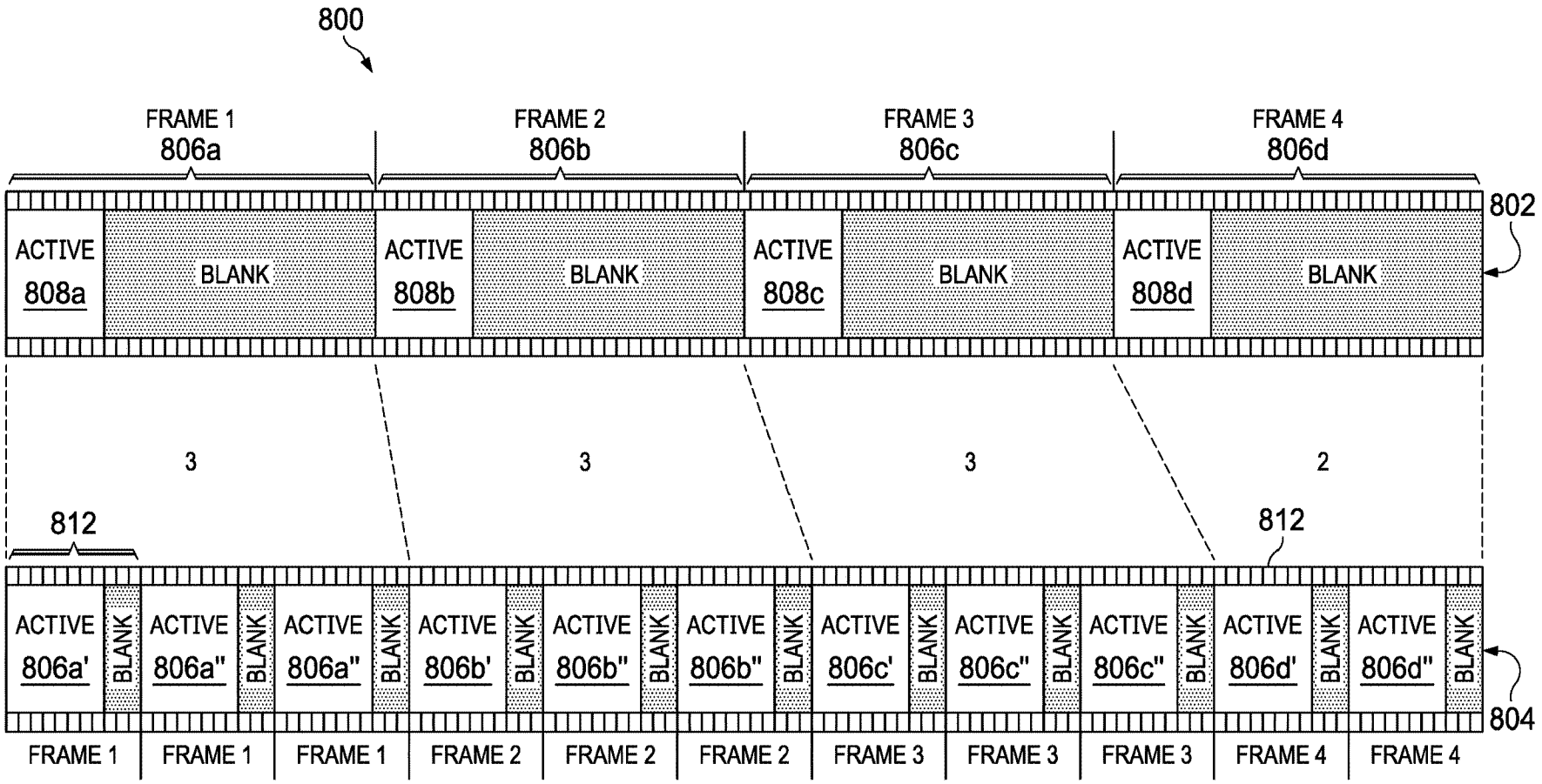

FIG. 8 illustrates an example timing diagram showing how a video frame response time enhancement system may repeat the frames of a low frame rate video stream to form a high frame rate video stream according to another embodiment of the present disclosure.

Figure 9:
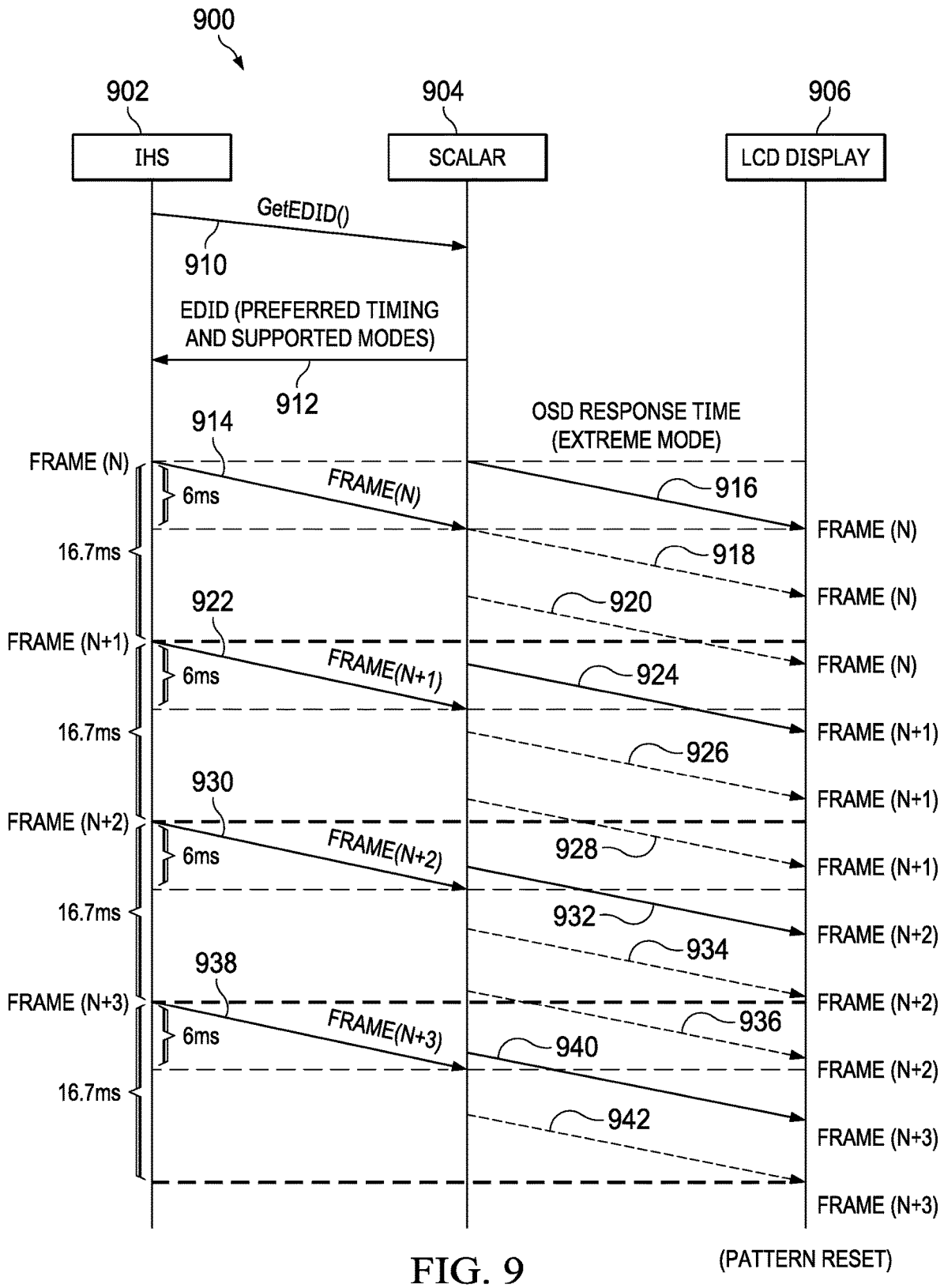

FIG. 9 is a flow diagram depicting certain steps of one embodiment of a video frame response time enhancement method according to another embodiment of the present disclosure.

Figure 10:
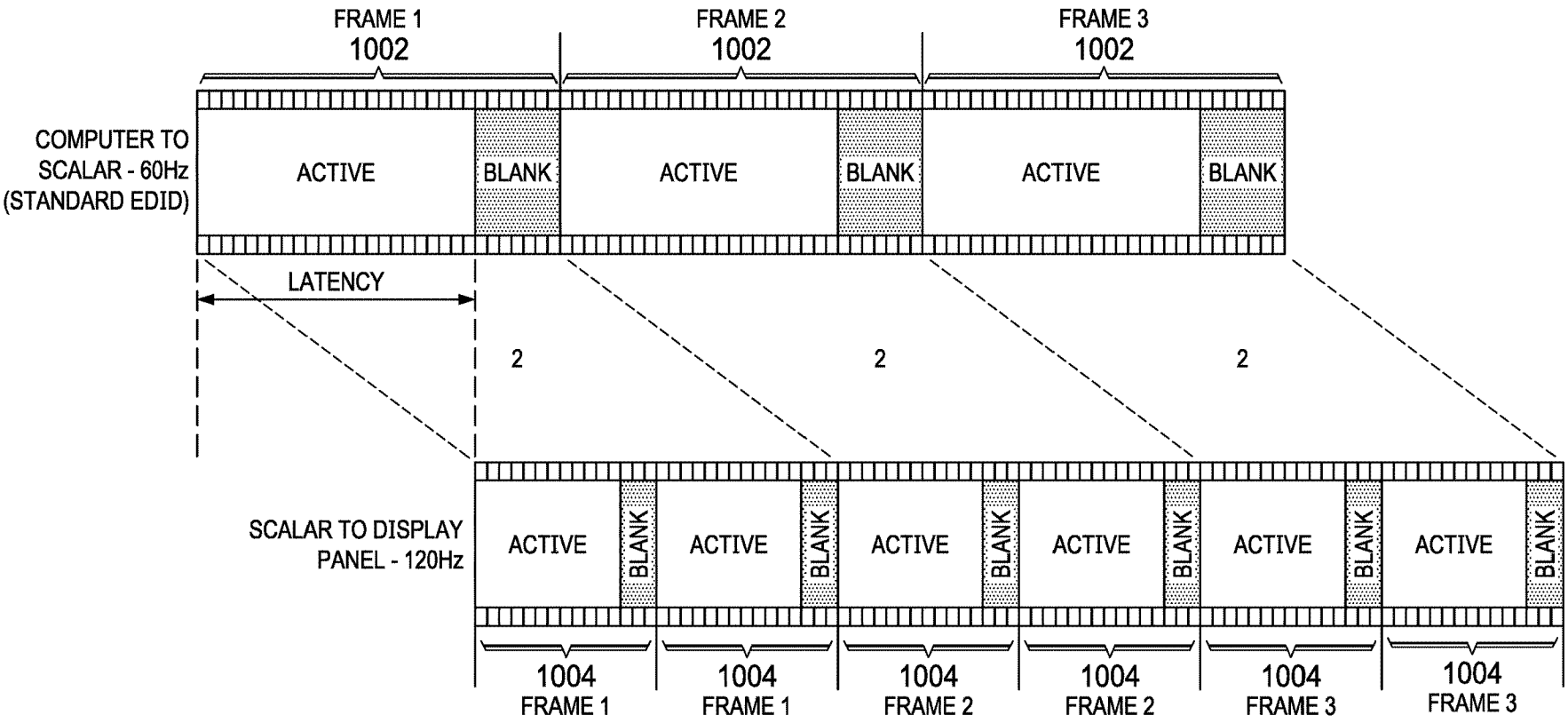

FIG. 10 illustrates a frame doubling technique has been devised in which each low frame rate frame is generated twice when sent to the LCD panel such that the resulting video imagery operates at an effective frame rate of 120 Hertz.

DETAILED DESCRIPTION

According to various embodiments of the present disclosure, a system and method for providing fast response time performance with low latency in Liquid Crystal Displays (LCDs) are described. Conventional techniques for adapting a display device with high frame rate capabilities to function with an IHS that only generates low frame rate video streams have enjoyed limited success, particularly when used with Liquid Crystal Display (LCD) devices that use Response Time Compensation (RTC) for enhancing the display's performance. Embodiments of the present disclosure provide a solution to these problems, among others, by using a pulldown technique in which low frame rate video streams are repeated in a manner which leverages the high frame rate of the LCD display while maintaining a latency of the LCD display at a relatively low level.

As gaming displays gain popularity in the consumer market, consumers are paying more attention to the response time and motion blur of a display, which can be a pivotal factor in how well the display accurately reproduces imagery generated by games, and in particular action games that can generate fast moving imagery. Liquid Crystal Displays (LCDs) have an inherently poor response time relative to other types (e.g., Organic Light Emitting Diode (OLED) displays, cathode ray tube (CRT) displays, etc.).

Various Response Time Compensation (RTC) or Overdrive Compensation (OD) techniques have been developed. Response times are usually measured from grey-to-grey transitions, called as G-to-G response time or Grey Level Response Time (GLRT). Response time compensation (RTC), also known as "overdrive" (OD) technology, may be used to reduce GLRT and improve or reduce motion blur. The OD method can be implemented using a matrix grey level's Look-Up Table (LUT). For example, a 17×17 LUT may be suitable for an 8-bit panel. Because an 8-bit panel has 256 grey levels, and each grey to each grey transition is associated with an OD grey level, there are 272 OD values in the 17×17 LUT.

When using the OD technique, however, an overshoot and/or undershoot effect is inevitably introduced which can significantly impact the human visual system (HVS)'s perception and lead to motion blur or inverse ghosting. On one hand, weak OD with zero-or-less overshoot and/or undershoot does not eliminate the trailing motion artifact and/or ghosting effect which leads to motion blur. On the other hand, strong OD can introduce serious overshoot and/or undershoot effects on the pixel images to cause inverse ghosting where double image, or even color mismatch artifact is observed and leads to poor user experience. These problems are further exacerbated when a high frame rate LCD display is coupled to an IHS that only generates low frame rate video streams. Because the OD techniques are tuned to function at a certain predetermined frame rate, when a low frame rate video stream is encountered, the performance of the video imagery diminishes.

FIG. 1 is a graph 100 illustrating how utilizing a LCD display device with RTC/OD compensation designed for high frame rate video streams may encounter problems when processing a low frame rate video stream. $G_{Start}(G_S)$ is the starting initial grey level, and $G_{Target}$ $(G_T)$ is the ending target grey level. Acceptable $G_{overshoot}$ $(G_{OS})$ represents an amount of overshoot that yields good video imagery, while unacceptable $G_{overshoot}$ $(G_{OS})$ represents an amount of overshoot that yields bad video imagery. The overdriven grey level transition from $G_{Start}(G_S)$ to $G_{target}(G_T)$ for each curve 102, 104, 106 generally comprises two segments: the first frame (from N to N+1) follows the native GLRC from $G_{Start}(G_S)$ to $G_{overshoot}(G_{OS})$, and the second segment follow another native GLRC from $G_{overshoot}(G_{OS})$ to $G_{target}(G_T)$.

In particular, curve 102 is a first overdriven grey level response curve (GLRC) representing a level of overdrive that is experienced by a high frame rate LCD display operating with a 165 Hertz (6.0 millisecond) frame rate. Curve 104 is a second GLRC representing a level of overdrive that is experienced by a high frame rate LCD display operating with a 60 Hertz (16.7 millisecond) frame rate using the same high frame rate LUT that is used to generate curve 102. Curve 106, on the other hand, is a third GLRC representing a level of overdrive that is experienced by a high frame rate LCD display operating with a 60 Hertz (16.7 millisecond) frame rate using a low frame rate (e.g., 60 Hz) LUT.

FIGS. 2A, 2B, and 2C illustrate video imagery 200, 202, 204 that may result via the first, second, and third GLRC curves of FIG. 1 according to one embodiment of the present disclosure. As shown in FIG. 2A, the first curve 102 possesses acceptable overshoot because the OD processed by the LUT is properly matched to the frame rate of the video stream. In FIG. 2B, the video imagery 202 of the second curve 104, however, possesses unacceptable overshoot resulting in inverse ghosting due to the high frame rate (e.g., 165 Hertz) LUT being used with a low frame rate (e.g., 60 Hertz) video signal. In FIG. 2C, the third curve 106 possesses acceptable overshoot because the OD processed by the LUT is properly matched to the frame rate of the video stream. The third curve 106, however, may not enjoy the relatively fast response times possessed by the video imagery 200 at the high frame rate. Thus as can be seen, it would be beneficial for the LCD display to operate at the fast frame rate, by using the same LUT used to process high frame rate video imagery, while also being able to process low frame rate video streams.

Conventional techniques have been implemented to address these issues, but they often engender other problems with reproducing quality imagery. FIG. 10, for example, illustrates a frame doubling technique has been devised in which each low frame rate (e.g., 60 Hertz) frame 1002 is generated twice when sent to the LCD panel such that the resulting video imagery (e.g., frames 1004) operates at an effective frame rate of 120 Hertz. This frame doubling sequence, however, is delayed at least one frame period (e.g., 16.7 milliseconds) before being sent to the LCD panel. Such an arrangement, therefore, results in unnecessary latency of the resulting video imagery. Embodiments of the present disclosure provide a solution to this problem, among others, by using a frame repeat sequence that leverages the high frame rate of the LCD display while reducing or eliminating latency incurred by the resulting video imagery.

For purposes of this disclosure, an Information Handling System (IHS) may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an IHS may be a personal computer (e.g., desktop or laptop), tablet computer, mobile device (e.g., Personal Digital Assistant (PDA) or smart phone), server (e.g., blade server or rack server), a network storage device, or any other suitable device and may vary in size, shape, performance, functionality, and price. An IHS may include Random Access Memory (RAM), one or more processing resources such as a Central Processing Unit (CPU) or hardware or software control logic, Read-Only Memory (ROM), and/or other types of nonvolatile memory.

Additional components of an IHS may include one or more disk drives, one or more network ports for communicating with external devices as well as various I/O devices, such as a keyboard, a mouse, touchscreen, and/or a video display. An IHS may also include one or more buses operable to transmit communications between the various hardware components.

FIG. 3 illustrates a block diagram of example components of an Information Handling System (IHS) configured to implement a Response Time Compensation (RTC) system for progressive scan LCD displays according to one embodiment of the present disclosure. As shown, IHS 300 includes a plurality of processing components, including LCD display 320 disposed in a housing 322. In various implementations, video artifacts related to "smearing" or "ghosting" of motion video as displayed on LCD display 320 can be mitigated while reducing the number of computational cycles and graphics controller power overhead.

Components of IHS 300 may include, but are not limited to, processor 302 (e.g., central processor unit or "CPU"), input/output (I/O) device interface 304, such as a display, a keyboard, a mouse, and associated controllers, hard drive or disk storage 306, various other subsystems 308, network port 310, and system memory 312. Data is transferred between the various system components via various data buses illustrated generally by bus 314. Video optimizer system 318 couples I/O device interface 304 to LCD display 320, as described in more detail below.

In some implementations, IHS 300 may not include each of the components shown in FIG. 3. In other implementations, IHS 300 may include other components in addition to those that are shown in FIG. 3. Furthermore, some components that are represented as separate components in FIG. 3 may instead be integrated with other components. For example, all or a portion of the functionality provided by two or more discrete components may instead be provided by components that are integrated into processor(s) 302 as a systems-on-a-chip.

FIG. 4 illustrates an example overdrive (OD) LUT 400 that may be used to implement the fast response time system according to one embodiment of the present disclosure. The LUT 400 as shown and described is a 17×17 matrix of values used to map grey values. Nevertheless, it should be appreciated that embodiments of the present disclosure may implemented with any suitably sized LUT, such as one having matrix values greater than 17×17 and/or one having matrix values less than 17×17.

In this 17×17 LUT, 17 "from" grey levels 0-255 (vertical) are mapped to 17 "to" grey levels 0-255 (horizontal). Each column/row intersection contains, for a particular "from/to" combination, a predetermined OD grey level. For example, if the initial grey level is 176 and the target grey level is 208, the OD grey level value is set to 216 to provide an overshooting boost or compensation. Conversely, if the initial grey level is 96 and the target grey level is 48, the OD grey level value is set to 33 to provide an undershooting boost or compensation.

FIG. 5 is a block diagram illustration of an embodiment of a Response Time Compensation (RTC) system 500 as generally implemented with timing controller 504, FIFO frame buffer 514, and LCD display 520. LCD display 520 comprises row drivers 506 and column drivers 508. Reference voltages 510 are supplied to column drivers 508 and LCD display 520 in a resistive-string, digital-to-analog converter (RDAC), column-driven architecture. In one embodiment, at least a portion of the RTC system 512, timing controller 504, and/or FIFO frame buffer 514 may be embodied as a scalar device that is configured in the LCD display.

Timing controller 504 is coupled to row drivers 506 and column drivers 508, which map grey level values to voltage nodes on a series resistance string. Column drivers 508 predetermine the voltage needed at each node to achieve the associated brightness level required to produce the intended grey level value. As grey level commands in digital video stream data 502 are received by timing controller 504, RTC logic 512 retrieves the previous grey level to the corresponding element within the video data stream from FIFO frame buffer 514.

Simultaneously, RTC logic 512 stores the current grey level in FIFO frame buffer 514 for use in the next frame. RTC logic 512 then compares the current and previous grey level commands for each separate red, green and blue (RGB) element using separate RGB look-up tables 516. The contents of RGB look-up tables 516 provide a unique grey level surrogate for each pairing of current and previous grey level commands, which is used to calculate the value of grey level substituted boost.

Grey level substituted boost commands are communicated by RTC logic 512 through data link 518 to column drivers 508, which then produce an override, or "over-drive" command to deliver appropriate higher voltage to the voltage node. Delivering the higher voltage results in compensated response, thereby reducing video artifacts that can contribute to smearing of video images containing motion.

In other embodiments, RTC 512, Frame Buffer FIFO 514, and Look-Up Tables 516 may all be implemented within a scalar processor, which may be disposed outside of the LCD panel module. In those cases, the data input into timing controller 504 may be RTC-processed. That is, the scalar processor may complete the RTC and then pass processed data to timing controller 504 for LCD device 520 to render.

FIG. 6 illustrates an example timing diagram 600 showing how a video frame response time enhancement system may repeat the frames of a low frame rate video stream 602 to form a high frame rate video stream 604 according to one embodiment of the present disclosure. In one embodiment, the low frame rate video stream 602 may be one that is generated by the IHS and transmitted to the scalar device of the LCD device, and the high frame rate video stream 604 may be one that is sent from the scalar device to the LCD device, such as the scalar device and LCD device 520 as described above with respect to FIG. 5. The low frame rate video stream 602 is shown as having three frames 606*a-c*; nevertheless, it should be appreciated that the low frame rate video stream 602 may include multiple ongoing frames 606*a-c* that are continually generated as the low frame rate video stream 602 is actively being generated.

Each frame 606*a-c* includes an active portion 608*a-c* in which pixel luminance information is being transmitted, and a blank portion 610*a-c* in which no pixel information is being transmitted. In one embodiment, frames 606*a-c* are customized video frames in which the active portions 608*a-c* are transmitted in a fast mode (e.g., 120 Hertz), while the overall frame duration is maintained at a low frame rate mode (e.g., 60 Hertz). For example, the timing controller 504 may, using the DDC channel, instruct the IHS to send frames 606*a-c* using such a timing sequence. Embodiments of the present disclosure may provide certain advantages in that, because the action portions 608*a-c* are transmitted more quickly, a LUT designed for use with high frame rate video streams may be used without any substantial degradation in the performance of the LCD device's capabilities.

The video frame response time enhancement system generates the high frame rate video stream 604 by simultaneously sending each active portion 608*a-c* to the LCD device as it is being received, and repeatedly sending that same frame 606*a-c* to the LCD device within the time window of the current frame. For example, the video frame response time enhancement system generates the high frame rate video stream 604 by sending active portions 608*a*' and 608*a*" to LCD device during the time window of the frame 606*a* and so on for all frames 606*a-c* generated by the IHS.

FIG. 7 is a flow diagram depicting certain steps of one embodiment of a video frame response time enhancement method 700 according to one embodiment of the present disclosure. In one embodiment, at least a portion of the steps of the method 700 may be performed by the video optimizer system 318 on a target computing device, such as IHS 300. The method 700 is described herein as being performed with an IHS 702 that generates a 60 Hertz frame rate video stream, and an LCD display 706 that is capable of rendering a 120 Hertz frame rate video stream such as described above with reference to FIG. 6. Nevertheless, it should be understood that the method 700 may be adapted for use with an IHS that generates any suitable low frame rate video stream, and a LCD display 706 capable of rendering any high frame rate video stream.

Initially at step 710, the IHS 702 issues a request message to obtain the capabilities of the LCD display 706 from a scalar 704, such as one configured in a LCD device, and in response, receive a response indicating the capabilities of the LCD device 120 at step 712. In one embodiment, the request message and response message comprise Extended Display Identification Data (EDID) formatted messages, which are published by the Video Electronics Standards Association (VESA). For example, the IHS 702 may issue the request message each time the IHS 702 is rebooted and/or the LCD device 706 is connected to the IHS 702, such as when a HDMI cable is plugged into the IHS 702. In one embodiment, the method 700 may instruct video optimizer system 318 and/or I/O interface 304 to generate customized video frames in which the active portions 608*a-c* of each frame 606*a-c* are transmitted in a fast mode (e.g., 120 Hertz), while the overall frame duration is maintained at a low mode (e.g., 60 Hertz).

Thereafter at step 714, the method 700 transmits the active portion 608*a* of a first frame 606*a* to the scalar 704 in which the scalar 704 simultaneously forwards the received active portion 608*a* to the LCD device 706 at step 716. During this time, the scalar 704 stores the received active portion 608*a* in a buffer or other suitable storage device. Because the active portion 608*a* has been transmitted to the scalar 704 at the fast frame rate (e.g., 8.3 milliseconds), only half (e.g., 50 percent) of the current time window has transpired. Thus at step 718, the scalar may transmit the stored active portion 608*a* to the LCD device 706 during the second half portion of the current time window of the first frame 606*a*.

To process the second frame 606*b*, the method 700 transmits the active portion 608*b* of a second frame 606*b* to the scalar 704 at step 720 in which the scalar 704 simultaneously forwards the received active portion 608*b* to the LCD device 706 at step 722. During this time, the scalar 704 stores the received active portion 608*b* in the buffer. Again, because the active portion 608*b* has been transmitted to the scalar 704 at the fast frame rate (e.g., 8.3 milliseconds), only half (e.g., 50 percent) of the current time window has transpired. Thus at step 724, the scalar may transmit the stored active portion 608*b* to the LCD device 706 during the second half portion of the current time window of the second frame 606*b*.

To process the third frame 606*c*, the method 700 transmits the active portion 608*c* of a third frame 606*c* to the scalar 704 at step 726 in which the scalar 704 simultaneously forwards the received active portion 608*c* to the LCD device 706 at step 728. During this time, the scalar 704 stores the received active portion 608*c* in the buffer. Thereafter at step 730, the scalar 704 may transmit the stored active portion 608*c* to the LCD device 706 during the second half portion of the current time window of the third frame 606*c*.

Although the method 700 only describes only three video frames 606*a-c* that may be processed, it should be understood that the method 700 continues to continually process video frames 606*a-c* at an ongoing basis to render a high frame rate video stream from a low frame rate video stream by repeating active portions 608*a-c* during the current time window of the current frame 606*a-c*. Nevertheless, when use of the method 700 is no longer needed or desired, the method 700 ends.

Although FIG. 7 describes an example method that may be performed for repeating active portions 608*a-c* during the current time window of the current frame 606*a-c*, the features of the method 700 may be embodied in other specific forms without deviating from the spirit and scope of the present disclosure. For example, the method 700 may perform additional, fewer, or different operations than those described in the present examples. As another example, the steps of the aforedescribed process may be performed in an order or sequence that is different than what is explicitly described above.

FIG. 8 illustrates another example timing diagram 800 showing how a video frame response time enhancement system may repeat the frames of a low frame rate video stream 802 to form a high frame rate video stream 804 according to another embodiment of the present disclosure. Whereas the embodiment of FIGS. 6 and 7 describe a technique for effectively converting a low frame rate video stream 602 to a high frame rate video stream 604 by repeating the active portion 608*a-d* once in each video frame 606*a-d*, the embodiment of FIGS. 8 and 9 describe a technique for effectively converting a low frame rate video stream 802 to a high frame rate video stream 804 by repeating the active portion 808*a-d* multiple times in each video frame 806*a-d*. In particular, the embodiment of FIGS. 8 and 9 describe a technique for converting a 60 Hertz (16.7 millisecond) frame rate video stream 802 into a 165 Hertz frame rate video stream 808 using an 11:4 pulldown as will be described in detail herein below.

The low frame rate video stream 802 may be one that is generated by the IHS 300 and transmitted to the scalar device of the LCD device, and the high frame rate video stream 804 may be one that is sent from the scalar device to the LCD device, such as the scalar device and LCD display 520 as described above with respect to FIG. 5. Each frame 806*a-d* includes an active portion 808*a-d* in which pixel luminance information is being transmitted, and a blank portion 810*a-d* in which no pixel information is being transmitted. In one embodiment, frames 806*a-d* are customized video frames in which the active portions 808*a-d* are transmitted in an extreme mode (e.g., 165 Hertz), while the overall frame duration is maintained at a low frame rate mode (e.g., 60 Hertz).

The video frame response time enhancement system generates the high frame rate video stream 804 by simultaneously sending each active portion 808*a-d* to the LCD display as it is being received, and repeatedly sending that same frame 806*a-d* to the LCD display within the time window of the current frame. For example, the video frame response time enhancement system generates the high frame rate video stream 804 by sending active portions 808*a*' and repeated frames 808*a*" to the LCD display during the time window of the frame 806*a* and so on for all frames 806*a-d* generated by the IHS 300.

For the process of converting a 60 Hertz frame rate video stream 802 to a 165 Hertz frame rate video stream 804, a series of four 60 Hertz video frames will be used to convert to eleven 165 Hertz frame rate video frames 812. For example, the active portion 808*a* of a first video frame 806*a* is replicated twice to form three 165 Hertz video frames 812 (e.g., one frame 806*a*' and two frames 806*a*") that are generated within the time window of the first video frame 806*a*, the active portion 808*b* of a second video frame 806*b* is replicated twice to form three 165 Hertz video frames 812 (e.g., one frame 806*b*' and two frames 806*b*") that are generated within the time window of the second video frame 806*b*, the active portion 808*c* of a third video frame 806*c* is replicated twice to form three 165 Hertz video frames 812 (e.g., one frame 806*c*' and two frames 806*c*") that are generated within the time window of the third video frame 806*c*, and the active portion 808*d* of a fourth video frame 806*n* is replicated once to form two 165 Hertz video frames 812 (e.g., one frame 806*d*' and one frame 806*d*") that are generated within the time window of the fourth video frame 806*d*. Thus, eleven 165 Hertz video frames 812 may be generated from four 60 Hertz video frames 806*a-d* to form the high frame rate video stream 804. Moreover, the sequence of four 60 Hertz video frames 806*a-d* being converted to eleven 165 Hertz frame rate video frames 812 may be repeated at ongoing intervals to generate the 165 Hertz frame rate video stream 804.

FIG. 9 is a flow diagram depicting certain steps of one embodiment of a video frame response time enhancement method 900 according to another embodiment of the present disclosure. In one embodiment, at least a portion of the steps of the method 900 may be performed by the video optimizer system 318 on a target computing device, such as IHS 300. The method 900 is described herein as being performed with an IHS 902 that generates a 60 Hertz frame rate video stream, and an LCD display 906 that is capable of rendering a 165 Hertz frame rate video stream such as described above with reference to FIG. 8. Nevertheless, it should be understood that the method 900 may be adapted for use with an IHS that generates any suitable low frame rate video stream, and an LCD display 906 capable of rendering any higher frame rate video stream.

Initially at step 910, the IHS 902 issues a request message to obtain the capabilities of the LCD display 906 from a scalar 904, such as one configured in the LCD display 906, and in response, receives a response indicating the capabilities of the LCD display 906 at step 912. In one embodiment, the request message and response message comprise Extended Display Identification Data (EDID) formatted messages, such as described above with reference to FIG. 7. In one embodiment, the method 900 may instruct video optimizer system 318 and/or I/O interface 304 to generate customized video frames in which the active portions of each frame 806*a-d* are transmitted in an extreme mode (e.g., 165 Hertz), while the overall frame duration is maintained at a low frame rate mode (e.g., 60 Hertz).

At step 914, the method 900 transmits the active portion 808*a* of a first frame 806*a* to the scalar 904 in which the scalar 904 simultaneously forwards the received active portion 808*a*' to the LCD display 906 at step 916. During this time, the scalar 904 stores the received active portion 808*a* in a buffer or other suitable storage device. Because the active portion 808*a* has been transmitted to the scalar 904 at the fast frame rate (e.g., 6.0 milliseconds), only approximately a third of the current time window has transpired. Thus at steps 918 and 920, the scalar 904 may transmit the stored active portion 808*a*' to the LCD display 906 twice during the following two-thirds (⅔) of the current time window of the first frame 806*a*.

To process the second frame 806*b*, the method 900 transmits the active portion 808*b* of a second frame 806*b* to the scalar 904 at step 922 in which the scalar 904 simultaneously forwards the received active portion 808*b*' to the LCD display 906 at step 924. During this time, the scalar 904 stores the received active portion 808*b* in the buffer. Again, because the active portion 808*b* has been transmitted to the scalar 904 at the fast frame rate (e.g., 6.0 milliseconds); thus, at step 926 and 928, the scalar may transmit the stored active portion 808*b*" to the LCD display 906 twice during the second two/thirds of the current time window of the second frame 806*b*.

To process the third frame 806*c*, the method 900 transmits the active portion 808*c* of a third frame 806*c* to the scalar 904 at step 930 in which the scalar 904 simultaneously forwards the received active portion 808*c*' to the LCD display 906 at step 932. During this time, the scalar 904 stores the received active portion 808*c* in the buffer. Thereafter at steps 934 and 936, the scalar 904 may transmit the stored active portion 808*c*" to the LCD display 906 twice during the second two/thirds of the current time window of the third frame 806*c*.

To process the fourth frame 806*d*, the method 900 transmits the active portion 808*d* of a fourth frame 806*d* to the scalar 904 at step 938 in which the scalar 904 simultaneously forwards the received active portion 808*d*' to the LCD display 906 at step 940. During this time, the scalar 904 stores the received active portion 808*d* in the buffer. Thereafter at steps 942, the scalar 904 may transmit the stored active portion 808*d*" to the LCD display 906 once during the remaining portion of the current time window of the fourth frame 806*d*.

Although the method 900 only describes how four low frame rate video frames 806*a-d* may be processed to generate eleven high frame rate video frames 812, it should be understood that the method 900 continues to continually process video frames 806*a-d* at an ongoing basis to render a high frame rate video stream from a low frame rate video stream by repeating active portions 808*a-d* one or more times during the current time window of the current frame 806*a-d*. Nevertheless, when use of the method 900 is no longer needed or desired, the method 900 ends.

Although FIG. 9 describes an example method that may be performed for repeating active portions 808*a-d* during the current time window of the current frame 806*a-d*, the features of the method 900 may be embodied in other specific forms without deviating from the spirit and scope of the present disclosure. For example, the method 900 may perform additional, fewer, or different operations than those described in the present examples. As another example, the steps of the aforedescribed process may be performed in an order or sequence that is different than what is explicitly described above.

It should be understood that various operations described herein may be implemented in software executed by processing circuitry, hardware, or a combination thereof. The order in which each operation of a given method is performed may be changed, and various operations may be added, reordered, combined, omitted, modified, etc. It is intended that the invention(s) described herein embrace all such modifications and changes and, accordingly, the above description should be regarded in an illustrative rather than a restrictive sense.

The terms "tangible" and "non-transitory," as used herein, are intended to describe a computer-readable storage medium (or "memory") excluding propagating electromagnetic signals; but are not intended to otherwise limit the type of physical computer-readable storage device that is encompassed by the phrase computer-readable medium or memory. For instance, the terms "non-transitory computer readable medium" or "tangible memory" are intended to encompass types of storage devices that do not necessarily store information permanently, including, for example, RAM. Program instructions and data stored on a tangible computer-accessible storage medium in non-transitory form may afterwards be transmitted by transmission media or signals such as electrical, electromagnetic, or digital signals, which may be conveyed via a communication medium such as a network and/or a wireless link.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

What is claimed is:

1. An Information Handling System (IHS), comprising:

a controller; and a memory coupled to the controller, the memory having program instructions stored thereon that, upon execution, cause the controller to:

receive LCD display capability information from a display device;

determine, using the received capability information, that a video stream sent to the display device has a lower frame rate than the capabilities of the display device; and increase the frame rate to, for each of a plurality of ongoing frames in the video stream:

receive one of the frames during a specified time window; and repeatedly send, to the display device, the one frame at least two times during the specified time window.

2. The IHS of claim 1, wherein the instructions, upon execution, further cause the controller to repeatedly send the one frame twice during the specified time window, wherein the original frame rate of the video stream is 60 Hertz and the increased frame rate is 120 Hertz.

3. The IHS of claim 1, wherein the instructions, upon execution, further cause the controller to repeatedly send the one frame three times during the specified time window, repeatedly send a second ensuing frame three times during a second specified time window, repeatedly send a third ensuing frame three times during a third specified time window and send a fourth ensuing frame twice, wherein the original frame rate of the of the video stream is 60 Hertz and the increased frame rate is 165 Hertz.

4. The IHS of claim 1, wherein the instructions, upon execution, further cause the controller to communicate with a scalar configured in the display device to perform the act of increasing the frame rate.

5. The IHS of claim 1, wherein the instructions, upon execution, further cause the controller to, instruct the scalar to receive an active portion of each frame at a high frame rate.

6. The IHS of claim 1, wherein the instructions are executed by a scalar configured in the display device.

7. The IHS of claim 1, wherein the display device comprises a Liquid Crystal Display (LCD) that is configured to use an overdrive (OD) technique for high frame rate video streams.

8. The IHS of claim 1, wherein the instructions, upon execution, further cause the controller to communicate with the scalar using a Data Display Channel (DDC) interface of the display device.

9. A video frame response time enhancement method comprising:

receiving LCD display capability information from a display device;

determining, using the received capability information, that a video stream sent to the display device has a lower frame rate than the capabilities of the display device; and increasing the frame rate by, for each of a plurality of ongoing frames in the video stream:

receiving one of the frames during a specified time window; and repeatedly sending, to the display device, the one frame at least two times during the specified time window.

10. The video frame response time enhancement method of claim 9, further comprising repeatedly send the one frame twice during the specified time window, wherein the original frame rate of the video stream is 60 Hertz and the increased frame rate is 120 Hertz.

11. The video frame response time enhancement method of claim 9, further comprising repeatedly sending the one frame three times during the specified time window, repeatedly send a second ensuing frame three times during a second specified time window, repeatedly send a third ensuing frame three times during a third specified time window and send a fourth ensuing frame twice, wherein the original frame rate of the of the video stream is 60 Hertz and the increased frame rate is 165 Hertz.

12. The video frame response time enhancement method of claim 9, further comprising communicating with a scalar configured in the display device to perform the act of increasing the frame rate.

13. The video frame response time enhancement method of claim 9, further comprising instructing the scalar to receive an active portion of each frame at a high frame rate.

14. The video frame response time enhancement method of claim 9, further comprising communicating with the scalar using a Data Display Channel (DDC) interface of the display device.

15. A memory storage device having program instructions stored thereon that, upon execution by a processor, cause an Information Handling System (IHS) to:

receive LCD display capability information from a display device;

determine, using the received LCD display capability information, that a video stream sent to the display device has a lower frame rate than the capabilities of the display device; and increase the frame rate to, for each of a plurality of ongoing frames in the video stream:

receive one of the frames during a specified time window; and repeatedly send, to the display device, the one frame at least two times during the specified time window.

16. The memory storage device of claim 15, wherein the instructions are further executed to repeatedly send the one frame twice during the specified time window, wherein the original frame rate of the video stream is 60 Hertz and the increased frame rate is 120 Hertz.

17. The memory storage device of claim 15, wherein the instructions are further executed to repeatedly send the one frame three times during the specified time window, repeatedly send a second ensuing frame three times during a second specified time window, repeatedly send a third ensuing frame three times during a third specified time window and send a fourth ensuing frame twice, wherein the original frame rate of the of the video stream is 60 Hertz and the increased frame rate is 165 Hertz.

18. The memory storage device of claim 15, wherein the instructions are further executed to communicate with a scalar configured in the display device to perform the act of increasing the frame rate.

19. The memory storage device of claim 15, wherein the instructions are executed by a scalar configured in the display device.

20. The memory storage device of claim 15, wherein the display device comprises a Liquid Crystal Display (LCD) that is configured to use an overdrive (OD) technique for high frame rate video streams.

* * * * *